US012043458B2

(12) United States Patent
Matsumoto

(10) Patent No.: US 12,043,458 B2
(45) Date of Patent: Jul. 23, 2024

(54) HERMETICALLY SEALED CONTAINER

(71) Applicant: HONDA MOTOR CO., LTD., Tokyo (JP)

(72) Inventor: Kenji Matsumoto, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 141 days.

(21) Appl. No.: 17/680,319

(22) Filed: Feb. 25, 2022

(65) Prior Publication Data

US 2022/0315300 A1 Oct. 6, 2022

(30) Foreign Application Priority Data

Mar. 31, 2021 (JP) ..... 2021-059881

(51) Int. Cl.
*B65D 53/02* (2006.01)
*B65D 43/02* (2006.01)

(52) U.S. Cl.
CPC ..... *B65D 53/02* (2013.01); *B65D 43/0218* (2013.01); *B65D 2543/00555* (2013.01); *B65D 2543/00972* (2013.01)

(58) Field of Classification Search
CPC ..... B65D 53/02; B65D 43/0218; B65D 2543/00972; B65D 2543/00555
USPC ..... 220/802
See application file for complete search history.

(56) References Cited

U.S. PATENT DOCUMENTS 10,150,596 B2 * 12/2018 Di Giuseppantonio ..... B65D 51/145
2018/0162608 A1 * 6/2018 Kim ..... B65D 51/18

FOREIGN PATENT DOCUMENTS

| | | | |
|---|---|---|---|
| JP | S5217975 | A | 2/1977 |
| JP | H04327144 | A | 11/1992 |
| JP | H53977 | U | 1/1993 |
| JP | 2001214998 | A | 8/2001 |
| JP | 2014228105 | A | 12/2014 |
| JP | 2019084766 | A | 6/2019 |
| JP | 6727564 | B2 * | 7/2020 |

* cited by examiner

*Primary Examiner* — Nathan J Jenness
*Assistant Examiner* — Madison L Poos
(74) *Attorney, Agent, or Firm* — CKC & Partners Co., LLC

(57) ABSTRACT

A hermetically sealed container includes a container body having a bottomed cylindrical shape that opens upward, a lid having a cylindrical portion that is fitted into an end portion on an upper opening side of the container body, the lid openably closing an upper opening of the container body, and a sealing member having an annular shape, the sealing member being provided on the cylindrical portion and hermetically sealing a gap between the cylindrical portion and the container body. The container body having a contact surface that the sealing member contacts, the contact surface being a tapered surface.

3 Claims, 3 Drawing Sheets

HERMETICALLY SEALED CONTAINER

This application is based on and claims the benefit of priority from Japanese Patent Application No. 2021-059881, filed on 31 Mar. 2021, the content of which is incorporated herein by reference.

BACKGROUND OF THE INVENTION

Field of the Invention

The present invention relates to a hermetically sealed container.

Related Art

Patent Document 1 below discloses a vacuum container for preserving samples that prevents oxidation of samples for electron microscopy and the like. In this vacuum container, when closing an opening with a lid, an O-ring is pressed against the container from above by the lid. As a result, the O-ring is elastically deformed so as to be compressed, thereby sealing the gap between the container and the lid.

In the case of the vacuum container disclosed in Patent Document 1, since the O-ring is compressed from above, the O-ring is subjected to a pressure that compresses it more than necessary. When the pressure in the vacuum container changes in that state, the O-ring deforms elastically while being maintained in a position under pressure. In this manner, the vacuum container disclosed in Patent Document 1 is hermetically sealed by the O-ring when the pressure in the container changes. Thus, in the vacuum container disclosed in Patent Document 1, even if the pressure in the container changes, the O-ring remains under more pressure than necessary. Therefore, it is desired to prevent the O-ring from being under more pressure than necessary when the pressure in the vacuum container changes.

In addition, in a container whose opening is hermetically sealed by an O-ring as described above, a configuration in which a lid is screwed to a hollow container body and fixed is known. In this case, an external thread is formed on the outer peripheral surface of the container body, and an internal thread is formed on the inner peripheral surface of the short cylindrical lid. Therefore, the lid can be screwed and attached to the container body. In this configuration, when the lid is screwed down completely, the O-ring is pressed against the container body from above by the lid. As a result, the O-ring elastically deforms so as to be compressed, thereby sealing the gap between the container body and the lid.

In such a configuration, loose screwing of the lid does not apply the necessary pressure to the O-ring and a seal is not formed. In that state, for example, if the pressure in the vacuum container is reduced, the pressure cannot be properly reduced because the vacuum container is not hermetically sealed.

Patent Document 1: Japanese Unexamined Utility Model Application, Publication No. H05-3977

SUMMARY OF THE INVENTION

It is an object of the present invention to provide a hermetically sealed container capable of adjusting pressure applied to a sealing member that seals a gap between a container body and a lid according to the pressure in the container.

A first aspect of the present invention includes a container body, a lid, and a sealing member. The container body has a bottomed cylindrical shape that opens upward. The lid has a cylindrical portion that is fitted into an end portion on an upper opening side of the container body. The lid openably closes an upper opening of the container body. The sealing member has an annular shape. The sealing member is provided on the cylindrical portion and hermetically seals a gap between the cylindrical portion and the container body. The container body has a contact surface that the sealing member contacts. The contact surface is a tapered surface.

In a second aspect of the present invention according to the first aspect, the cylindrical portion may have an opposing surface that faces the contact surface. The opposing surface may be a tapered surface inclined in a direction opposite to an inclination direction of the contact surface.

In a third aspect of the present invention according to the first aspect, the sealing member may a non-elastically deformable member.

According to the present invention, it is possible to provide a hermetically sealed container capable of adjusting pressure applied to a sealing member that seals a gap between a container body and a lid according to the pressure in the container.

DETAILED DESCRIPTION OF THE INVENTION

Specific embodiments of the present invention will now be described in detail with reference to the drawings.

Figure 1:
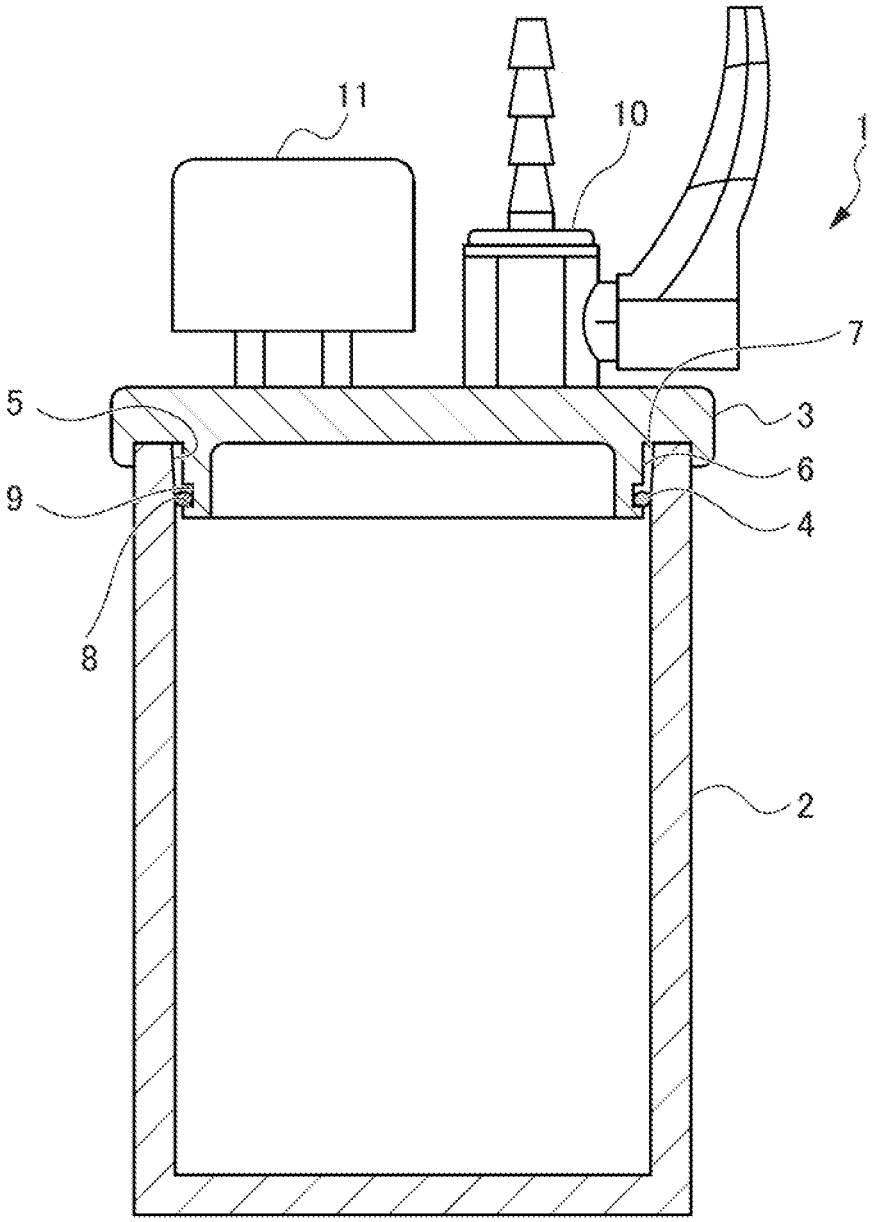
FIG. 1 is a longitudinal sectional view of a hermetically sealed container according to an embodiment of the present invention.
Figure 2A:
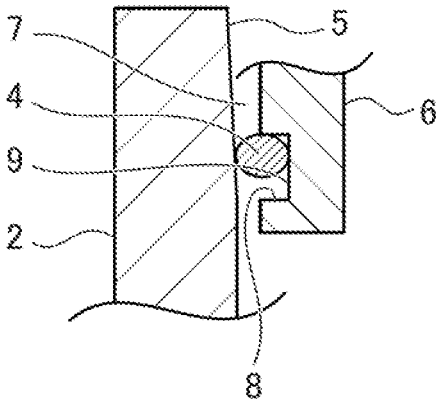
FIG. 2A is a longitudinal sectional view of the main part of the hermetically sealed container in FIG. 1.
Figure 2B:
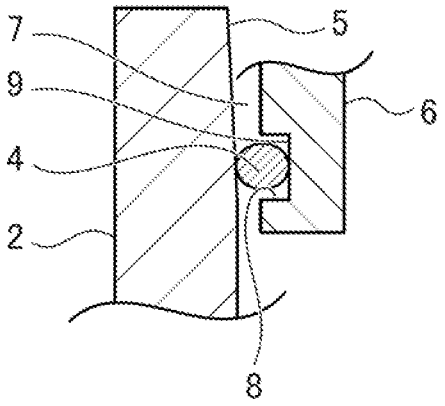
FIG. 2B is a longitudinal sectional view of the main part of the hermetically sealed container in FIG. 1.
Figure 2C:
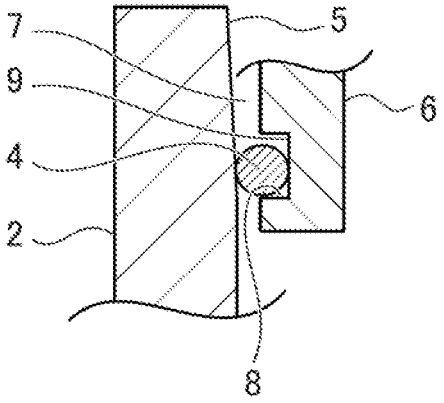
FIG. 2C is a longitudinal sectional view of the main part of the hermetically sealed container in FIG. 1.
Figure 2D:
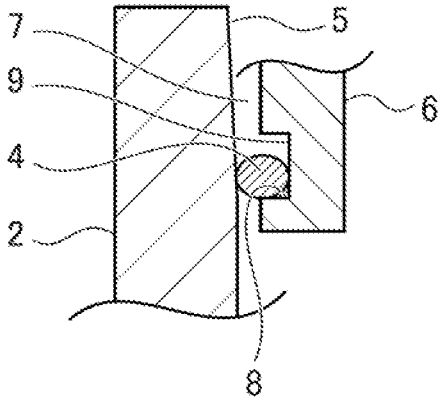
FIG. 2D is a longitudinal sectional view of the main part of the hermetically sealed container in FIG. 1.

FIG. 1 is a longitudinal sectional view of a hermetically sealed container according to an embodiment of the present invention. A hermetically sealed container 1 of the present embodiment includes a container body 2 having a bottomed cylindrical shape that opens upward, a lid 3 that openably closes an upper opening of the container body 2, and an annular sealing member 4 that seals a gap between the container body 2 and the lid 3.

The container body 2 is a member constituting a bottom wall and peripheral side wall of the hermetically sealed container 1. The container body 2 has a bottomed cylindrical shape that opens only upward. In the container body 2, a contact surface 5 that the sealing member 4 described below contacts is a tapered surface. In this embodiment, an inner peripheral surface of an end portion on an upper opening side of the container body 2 is the contact surface 5. This contact surface 5 has a tapered shape that increases in diameter in an upward direction.

The lid 3 has a short cylindrical shape that opens downward. The lid 3 has a cylindrical portion 6 that is fitted into the end portion on the upper opening side of the container body 2. The cylindrical portion 6 has a cylindrical shape with the axial direction along a vertical direction, and is integrally formed with a lower surface of a central portion of the lid 3 and extends downward. The outer diameter of the cylindrical portion 6 is smaller than the inner diameter of the peripheral side wall of the lid 3. Therefore, a cylindrical gap 7 is formed between the outer peripheral surface of the cylindrical portion 6 and the inner peripheral surface of the peripheral side wall of the lid 3. A groove 8 that opens radially outward is formed on the outer peripheral surface of the cylindrical portion 6 along a circumferential direction.

The lid 3 is attached to the container body 2 so as to close the upper opening of the container body 2. Specifically, the upper end portion of the peripheral side wall of the container body 2 is inserted into the cylindrical gap 7 until the lower surface of the lid 3 contacts the upper end surface of the peripheral side wall of the container body 2. In this state, the cylindrical portion 6 of the lid 3 is inserted into the upper opening of the container body 2.

When the cylindrical portion 6 of the lid 3 is inserted into the container body 2, since the contact surface 5 of the container body 2 is a tapered surface, the distance between the contact surface 5 of the container body 2 and a bottom surface 9 of the groove 8 formed in the cylindrical portion 6 differs between the upper and lower positions. In this embodiment, since the contact surface 5 has a tapered shape that increases in diameter in an upward direction, the distance between the contact surface 5 of the container body 2 and the bottom surface 9 of the groove 8 becomes smaller in a downward direction.

The sealing member 4 is an O-ring having a circular longitudinal section and is elastically deformable. The sealing member 4 is provided on the cylindrical portion 6 of the lid 3. In the illustrated examples, the sealing member 4 is mounted on the groove 8 of the cylindrical portion 6 of the lid 3. When the upper opening of the container body 2 is closed by the lid 3 as described above with the sealing member 4 mounted on the groove 8, the gap between the cylindrical portion 6 and the container body 2 is hermetically sealed by the sealing member 4. In the illustrated examples, the cylindrical portion 6 is inserted into the upper opening of the container body 2, so the sealing member 4 seals the gap between the outer peripheral surface of the cylindrical portion 6 and the inner peripheral surface of the peripheral side wall of the container body 2. In a state in which the gap between the cylindrical portion 6 and the container body 2 is sealed by the sealing member 4, the sealing member 4 contacts the contact surface 5 of the container body 2, and also contacts the bottom surface 9 of the groove 8 of the cylindrical portion 6. The diameter of the longitudinal section of the sealing member 4 is smaller than the width of the groove 8.

By sealing the gap between the cylindrical portion 6 and the container body 2 with the sealing member 4, the inside of the container 1 is hermetically sealed. In this embodiment, in its hermetically sealed state, the gas in the container 1 is evacuated to the outside, and the interior of the container 1 is depressurized. Depressurization of the interior of the container 1 is performed by means of a vacuum pump or other depressurizing means not shown. The depressurizing means is connected to the hermetically sealed container 1 via an exhaust path not shown. The exhaust path is connected to a ball valve 10 provided on the lid 3. The ball valve 10 is a valve that opens and closes the exhaust path. Accordingly, by opening the ball valve 10 and activating the depressurizing means, the gas in the container 1 can be evacuated to the outside through the exhaust path to depressurize the interior of the container 1. The pressure in the container 1 is detected by a negative pressure gauge 11 provided on the lid 3.

FIGS. 2A to 2D are longitudinal sectional views of the main part of the hermetically sealed container in FIG. 1. Specifically, FIGS. 2A to 2D are schematic enlarged longitudinal sectional views showing the sealing part between the container body 2 and the lid 3. The pressure in the container 1 differs between each of FIGS. 2A to 2D. The pressure in the container 1 decreases in the order of FIG. 2A, FIG. 2B, FIG. 2C, and FIG. 2D.

As shown in FIGS. 2A to 2D, the container 1, the sealing member 4 moves downward as the pressure in the container 1 decreases. Therefore, the vertical position of the sealing member 4 changes as the pressure in the container 1 changes. In other words, the contact position of the sealing member 4 with the contact surface 5 varies in a vertical direction. In this case, since the distance between the contact surface 5 of the container body 2 and the bottom surface 9 of the groove 8 is different as described above, the pressure applied to the sealing member 4 is different. Thus, according to the hermetically sealed container 1 of this embodiment, the pressure applied to the sealing member 4 can be adjusted when the pressure in the container 1 changes. Therefore, when the pressure in the container 1 is changed to a certain pressure and left for a long period of time, the pressure in the container 1 changes due to the pressure in the container 1 being released or the like. The sealing member 4 moves in response to the change, and thereby the pressure applied to the sealing member 4 can be adjusted. The inclination angle of the contact surface 5 is formed in advance so that a pressure corresponding to the pressure in the container 1 is applied to the sealing member 4. Accordingly, an optimum pressure can be applied to the sealing member 4 according to the depressurization state in the container 1.

In addition, the hermetically sealed container 1 of the present embodiment does not require a thread structure, unlike the conventional configuration in which the lid is screwed to the container body. Therefore, according to the hermetically sealed container 1 of this embodiment, the container can be reduced in size by an amount equivalent to the size of the thread structure. Further, in the case of the hermetically sealed container 1 of the present embodiment, since the contact surface 5 of the container body 2 is a tapered surface, it is possible to suppress twisting of the sealing member 4 due to the contact between the sealing member 4 and the contact surface 5 when attaching the lid 3 to the container body 2, compared to the case where the contact surface is vertical. Moreover, in the present embodiment, even if some twisting occurs, the twisting can be eliminated because the sealing member 4 moves by depressurizing the interior of the container 1.

Figure 3:
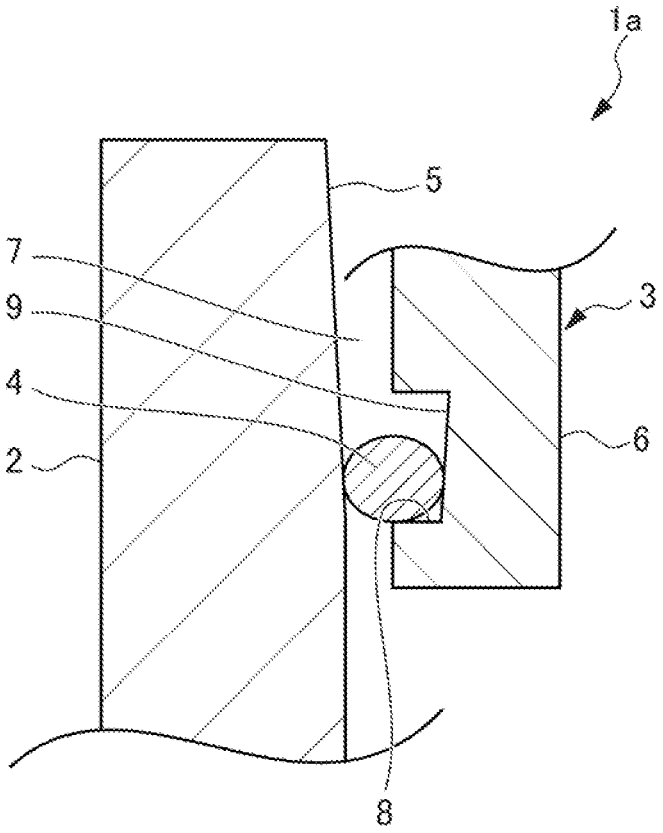
FIG. 3 is a longitudinal sectional view of a modification of the hermetically sealed container of the present invention.

FIG. 3 is a longitudinal sectional view of a modification of the hermetically sealed container of the present invention. This drawing shows only the sealing part between the container body 2 and the lid 3. In this modification, the features are described, and the matters described in the above embodiment are omitted.

In a hermetically sealed container 1*a* of this modification, the opposing surface facing the contact surface 5, of the cylindrical portion 6 is a tapered surface. In this modification, the bottom surface 9 of the groove 8 is the opposing surface. This opposing surface 9 is a tapered surface inclined in a direction opposite to the inclination direction of the contact surface 5 of the container body 2. In this modification, the opposing surface 9 of the cylindrical portion 6 is tapered, reducing in diameter in an upward direction.

In this modification as well, the lid 3 is attached to the container body 2, and thereby the gap between the container body 2 and the cylindrical portion 6 is sealed by the sealing member 4. At this time, in a state in which the outer peripheral surface of the sealing member 4 contacts the contact surface 5 of the container body 2 and the inner peripheral surface of the sealing member 4 contacts the opposing surface 9 of the cylindrical portion 6, the gap between the inner peripheral surface of the container body 2 and the outer peripheral surface of the cylindrical portion 6 is sealed by the sealing member 4.

The present invention is not limited to the above embodiments (including the modification), and modifications and improvements to the extent that the object of the present invention can be achieved are included in the present invention.

For example, in the above embodiments, the contact surface 5 of the container body 2 is a tapered surface that increases in diameter in an upward direction, but conversely, it may be a tapered surface that reduces in diameter in an upward direction. In this case, the opposing surface 9 of the cylindrical portion 6 is a tapered surface that increases in diameter in an upward direction, contrary to the above modification. In such a configuration, the hermetically sealed container is used in a depressurized space. In the above embodiments, the sealing member 4 is an elastically deformable O-ring, but it may be a non-elastically deformable member. For example, the sealing member may be made of a metal that does not deform elastically. In this case, the sealing member is more easily moved in response to the pressure in the container. In the above modification, the longitudinal section of the opposing surface 9 of the cylindrical portion 6 has a straight tapered shape, but it may have a curved tapered shape.

EXPLANATION OF REFERENCE NUMERALS

1, 1*a*: hermetically sealed container
2: container body
3: lid
4: sealing member
5: contact surface
6: cylindrical portion
9: opposing surface

What is claimed is:

1. A hermetically sealed container having an interior that is depressurized, comprising:

a container body having a bottomed cylindrical shape that opens upward;

a lid having a cylindrical portion that is fitted into an end portion on an upper opening side of the container body, the lid openably closing an upper opening of the container body; and a sealing member having an annular shape, the sealing member being provided on the cylindrical portion and hermetically sealing a gap between the cylindrical portion and the container body, the container body having a contact surface that the sealing member contacts, the contact surface being a tapered surface, an inclination angle of the contact surface being formed so that a pressure corresponding to a pressure in the hermetically sealed container is applied to the sealing member, a groove that opens radially outward being formed on an outer peripheral surface of the cylindrical portion along a circumferential direction, and the sealing member being mounted on the groove and movable within the groove so that a contact position of the sealing member with the contact surface varies in a vertical direction.

2. The hermetically sealed container according to claim 1, wherein the cylindrical portion has an opposing surface that faces the contact surface, the opposing surface being a tapered surface inclined in a direction opposite to an inclination direction of the contact surface.

3. The hermetically sealed container according to claim 1, wherein the sealing member is a non-elastically deformable member.

* * * * *